US005704541A

United States Patent [19]

Mogard

[11] Patent Number: 5,704,541

[45] Date of Patent: Jan. 6, 1998

[54] FLAT-TOP CONTAINER WITH AN OPENING FITMENT

[75] Inventor: Jens Mogard, Buffalo Grove, Ill.

[73] Assignee: Tetra Laval Holdings & Finance S.A., Pully, Switzerland

[21] Appl. No.: 639,162

[22] Filed: Apr. 25, 1996

[51] Int. Cl.[6] ..... B65D 43/08

[52] U.S. Cl. ..... 229/125.15; 220/462; 220/465; 229/183

[58] Field of Search ..... 229/125.14, 125.15, 229/137, 138, 183; 220/403, 404, 460, 461, 465, 458, 462

[56] References Cited

U.S. PATENT DOCUMENTS

| | | | |
|---|---|---|---|
| 2,147,349 | 2/1939 | Piquerez . | |
| 2,432,462 | 12/1947 | Waters . | |
| 2,980,304 | 4/1961 | Sisco . | |
| 3,119,543 | 1/1964 | Walker | 220/465 X |
| 3,337,033 | 8/1967 | Cote | 229/138 X |
| 3,756,471 | 9/1973 | Wissman | 220/465 X |
| 4,174,051 | 11/1979 | Edwards et al. | 220/465 X |
| 4,246,062 | 1/1981 | Christine . | |
| 4,690,667 | 9/1987 | Domke . | |
| 4,726,468 | 2/1988 | Hesser et al. | 229/138 X |
| 4,788,811 | 12/1988 | Kawajiri et al. . | |
| 5,058,360 | 10/1991 | Yamazaki et al. . | |
| 5,088,642 | 2/1992 | Farber | 229/125.14 |
| 5,203,470 | 4/1993 | Brown | 229/125.15 X |
| 5,219,320 | 6/1993 | Abrams et al. . | |
| 5,248,054 | 9/1993 | Berggren et al. . | |
| 5,272,855 | 12/1993 | Togi et al. . | |
| 5,304,265 | 4/1994 | Keeler . | |
| 5,366,433 | 11/1994 | McCormick . | |
| 5,429,699 | 7/1995 | Abrams et al. . | |
| 5,435,803 | 7/1995 | Owen et al. . | |
| 5,473,857 | 12/1995 | Keeler . | |
| 5,484,374 | 1/1996 | Bachner et al. . | |

FOREIGN PATENT DOCUMENTS

| | | |
|---|---|---|
| 0513495A2 | 11/1992 | European Pat. Off. . |

*Primary Examiner*—Allan N. Shoap
*Assistant Examiner*—Christopher J. McDonald
*Attorney, Agent, or Firm*—McAndrews, Held & Malloy, Ltd.; Michael A. Catania

[57] ABSTRACT

A flat-top, hermetically sealed, paperboard-based container and apparatus and method of making it are set forth. The paperboard-based container includes a rectangular sleeve having upper end sections joined at fold lines with side walls. The upper end sections are divided into inner and outer opposed pairs which are folded toward one another in an overlapping manner to form a generally flat end for the container. Each of the inner and outer opposed sections includes a cutout. When the upper end sections are folded in and overlapping manner, the cutouts define an aperture having edges that include exposed paperboard substrate. Each of the inner pair of opposed end sections are divided along fold lines into a middle region and laterally opposed side regions. The laterally opposed side regions are folded onto the middle region and are sandwiched between the middle region and the outer pair of opposed sections when folded to form the container top. One of the outer pair of opposed upper end sections is longer than the other so that the longer outer end section overlaps exterior to the shorter of the outer pair of opposed upper end sections. An opening fitment is disposed through the aperture and includes a flange at the interior of the container. The flange covers the exposed edges of the aperture. The fitment is preferably a resealable cover, such as a resealable screw-type spout and cap or the like.

10 Claims, 8 Drawing Sheets

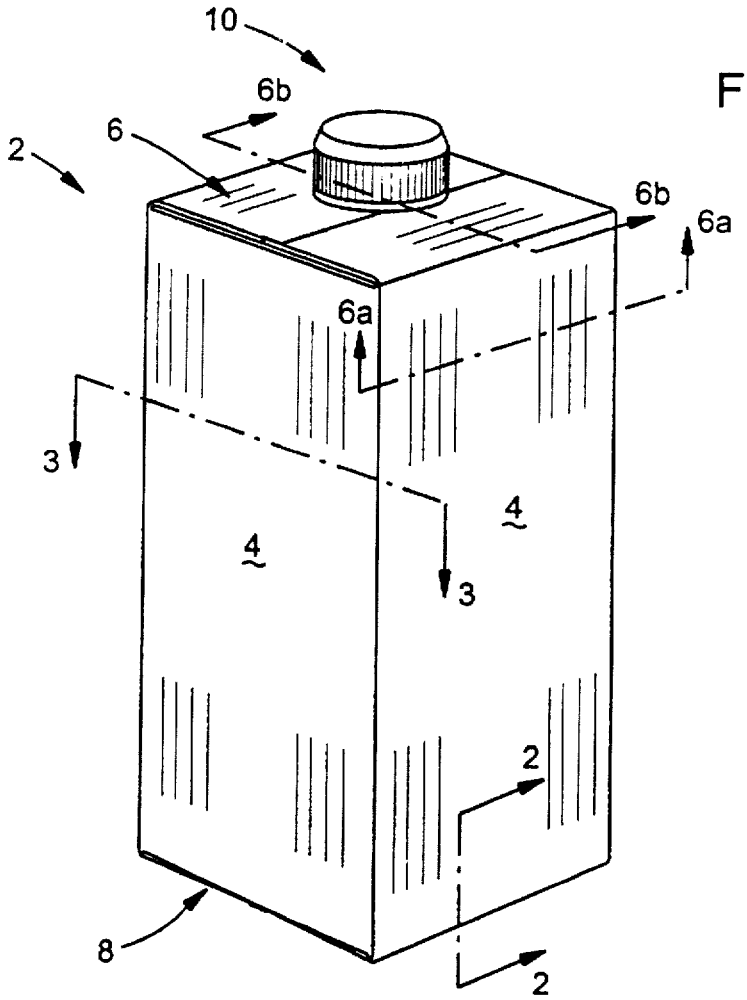
Fig. 1
Fig. 4
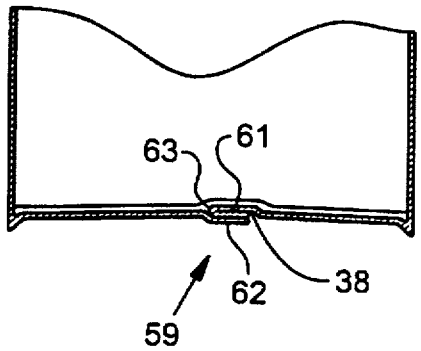
Fig. 3
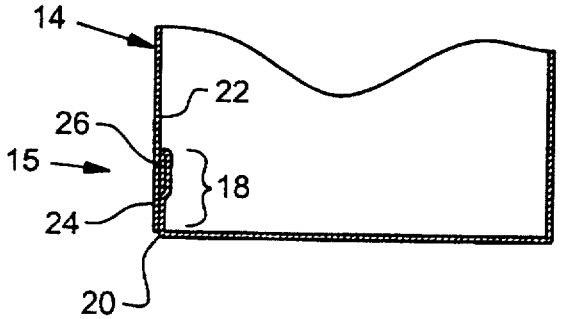

Fig. 2
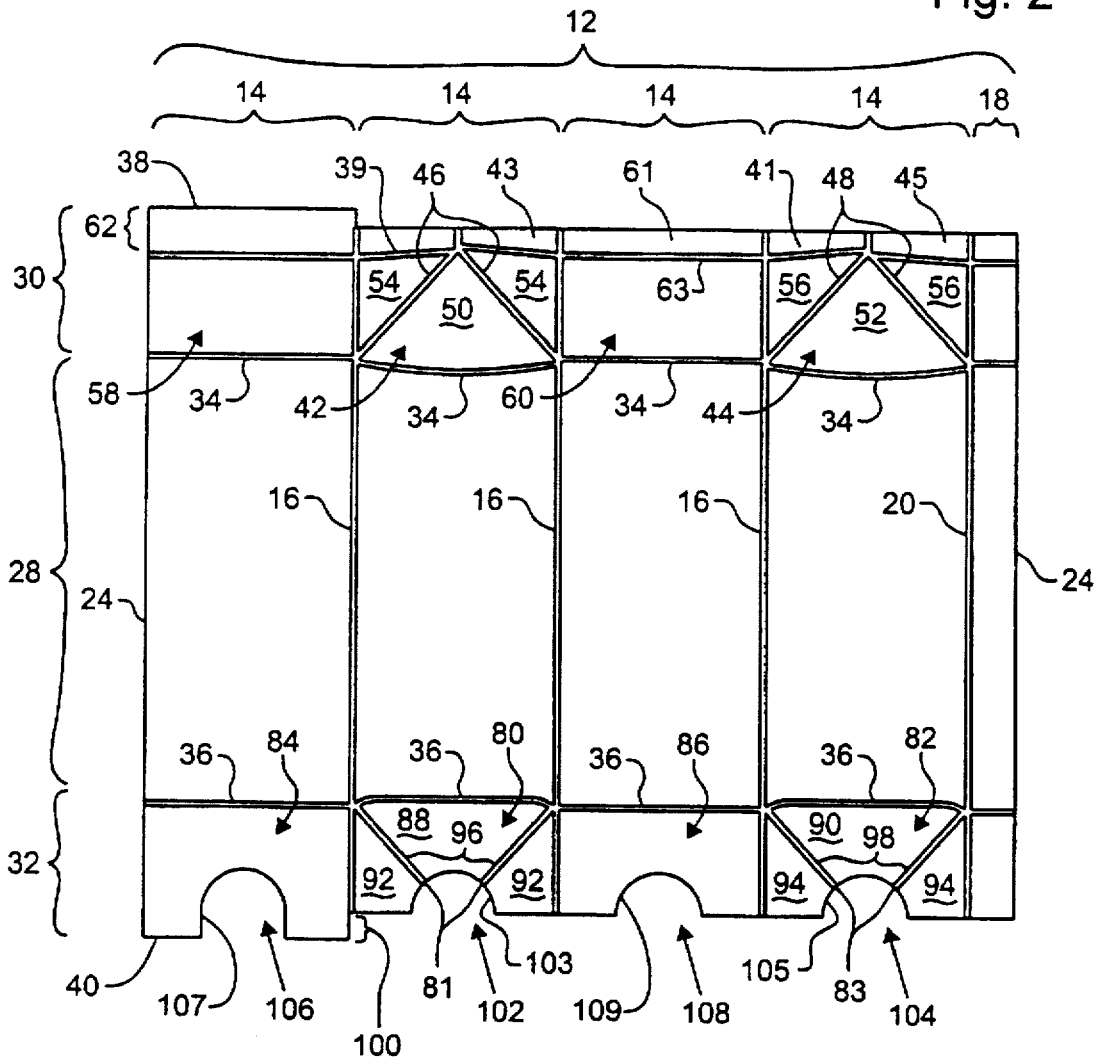
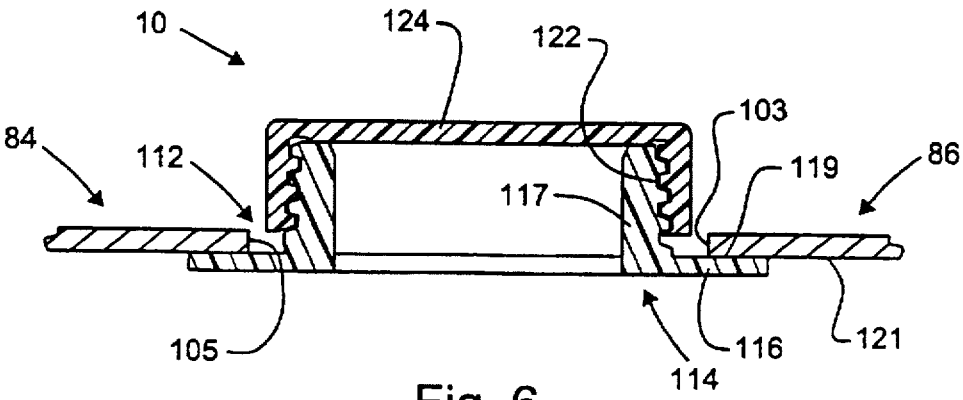
Fig. 6

Fig. 13
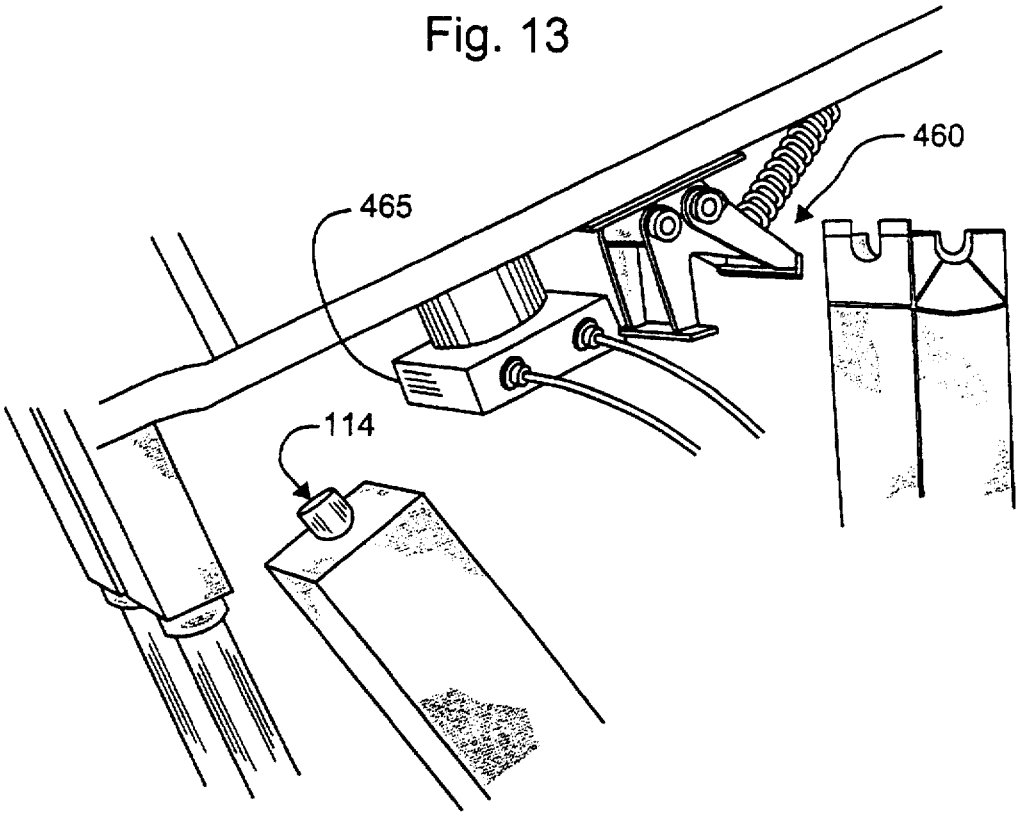
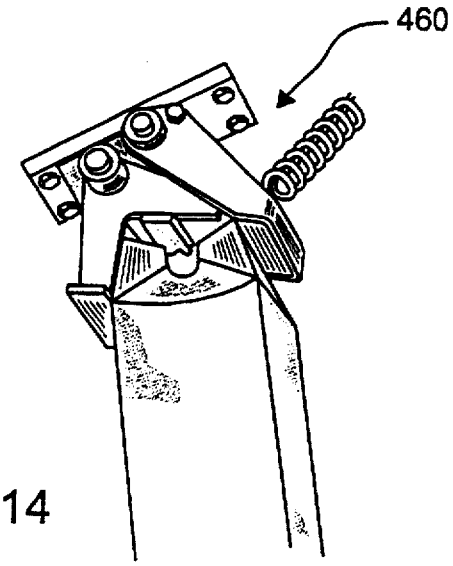
Fig. 14
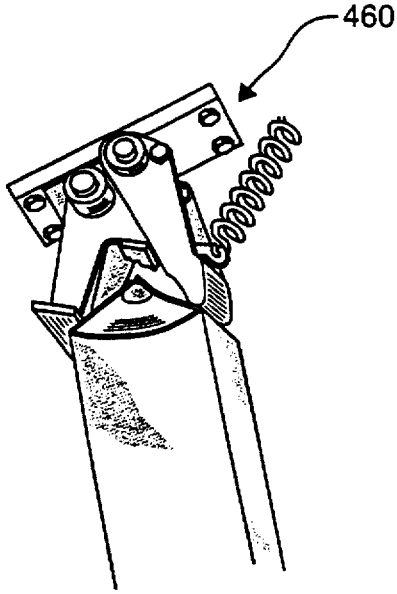
Fig. 15

FLAT-TOP CONTAINER WITH AN OPENING FITMENT

FIELD OF THE INVENTION

The present invention generally relates to an improved container and, more specifically, to a paperboard-based container having an opening fitment, wherein the container includes hermetically sealed upper and lower ends that prevent wicking of liquid products into the paperboard substrate of the container.

BACKGROUND OF THE INVENTION

Today, many types of disposable single-use packages or cartons exist for storing liquids, powders or the like. The liquids may include beverages, such as milk and juice. The containers may be formed from blanks or sheets made of a variety of laminate materials having a substrate such as paperboard, strawboard, pasteboard, cardboard and the like. The substrate material is laminated or coated with a thermoplastic or a similar liquid resistant coating to enable the container to retain liquids. The blanks are folded into a variety of container cross-sections, such as tubular, rectangular, square and the like.

It has been proposed to form rectangular cartons with side walls made from a paperboard-based laminate material wherein the upper end is made exclusively from a thermoplastic material. Such a proposal is made in U.S. Pat. Nos. 5,158,633 and 5,498,149. As disclosed therein, a thermoplastic material may be shaped and sealed to the container side walls by using an injection molding process. The upper end may be formed from a soft plastic strip placed over the end of the side walls and then heated and thermoformed to the side walls. The thermoform process is effected within an end mold such that the resultant plastic end cap conforms in shape to that of the mold. The end cap may be formed with an integral end cap which receives a plug. The end cap may be threaded to receive a screw cap.

The foregoing container having a thermoformed plastic end cap, depending on the circumstances, may be relatively difficult to manufacture and requires substantial tooling which is added to existing packaging machine. The resultant container may also be more expensive than a similarly shaped container which is entirely formed of the paperboard based laminate material.

Gable-top containers, either flattened or erect, are also quite popular and are an alternative to the thermoformed-top container discussed above. The flattened and erect gable shaped ends may include separate opening arrangements, such as a screw cap type fitment or the like. Exemplary opening arrangements are disclosed in U.S. Pat. No. 5,248,054; U.S. Pat. No. 2,980,304; and U.S. Pat. No. 2,432,462.

The conventional gabled-top containers, however, may also experienced limitations that are dependent upon the circumstances. Gable-shaped ends require more material than flat ends, even though gable shaped and flat ended containers provide the same storage volume. In addition, it is often difficult to manufacture a gable shaped container with a spout and cap. When adding the spout to the gable shaped container, it was added to the erected blank prior to forming the gable. Once the spout is added, the ends of the are folded, heated, and pressed together to form the familiar sealed fin of the gabled-top structure. The spout, however, must be located remote from the fin in order to avoid interference by the spout with the manufacturing equipment which heat seals the fin panels. Such remote placement of the cap often locates the cap in an awkward position to one side of the container.

To address these problems, conventional containers have been proposed with flat upper ends having a spout and cap opening in the center of the top. However, flat ended containers experience other limitations. In flat ended containers, the adjoining edges of the folded end panels produce seams. These seams expose edges of the paperboard substrate material to the liquid product within the container. The product undergoes a wicking or capillary action and is soaked into the paperboard core of the container thereby degrading the seals and compromising the integrity of the package. In addition, conventional flat ended containers are unable to achieve a hermetic seal along the seams produced at the upper end of the container. Thus, while conventional flat ended containers are liquid tight, such containers are not hermetically sealed and, therefore, are unable to maintain a pressurized interior chamber, such as is required to preserve carbonated liquids. In addition, the non-hermetic seams in conventional paperboard-based containers are an unsatisfactory medium for storing liquids which are highly sensitive to oxygen, such as wine, orange juice, or the like.

SUMMARY OF THE INVENTION

A flat-top, hermetically sealed, paperboard-based container and apparatus and method of making it are set forth. The paperboard-based container includes a rectangular sleeve having upper end sections joined at fold lines with side walls. The upper end sections are divided into inner and outer opposed pairs which are folded toward one another in an overlapping manner to form a generally flat end for the container. Each of the inner and outer opposed sections includes a cutout. When the upper end sections are folded in and overlapping manner, the cutouts define an aperture having edges that include exposed paperboard substrate. Each of the inner pair of opposed end sections are divided along fold lines into a middle region and laterally opposed side regions. The laterally opposed side regions are folded onto the middle region and are sandwiched between the middle region and the outer pair of opposed sections when folded to form the container top. One of the outer pair of opposed upper end sections is longer than the other so that the longer outer end section overlaps exterior to the shorter of the outer pair of opposed upper end sections. An opening fitment is disposed through the aperture and includes a flange at the interior of the container. The flange covers the exposed edges of the aperture. The fitment is preferably a resealable cover, such as a resealable screw-type spout and cap or the like, but may also be in the form of a generally flattened disc.

The foregoing container facilitates the providing of a paperboard-based container that is hermetically sealed and which can be manufactured with a reduced amount of packaging material per unit volume when compared to other selected container types. The forgoing container design may also be manufactured with a minimum amount of retooling of the container manufacturing equipment.

BRIEF DESCRIPTION OF THE DRAWINGS

FIGS. 1–7 illustrate a blank and container formed from the blank in accordance with one embodiment of the present invention.

FIGS. 8–15 illustrate one embodiment of an apparatus that may be used to form, fill, and seal the container of FIGS. 1–7.

DETAILED DESCRIPTION OF THE PREFERRED EMBODIMENTS

Figure 5:
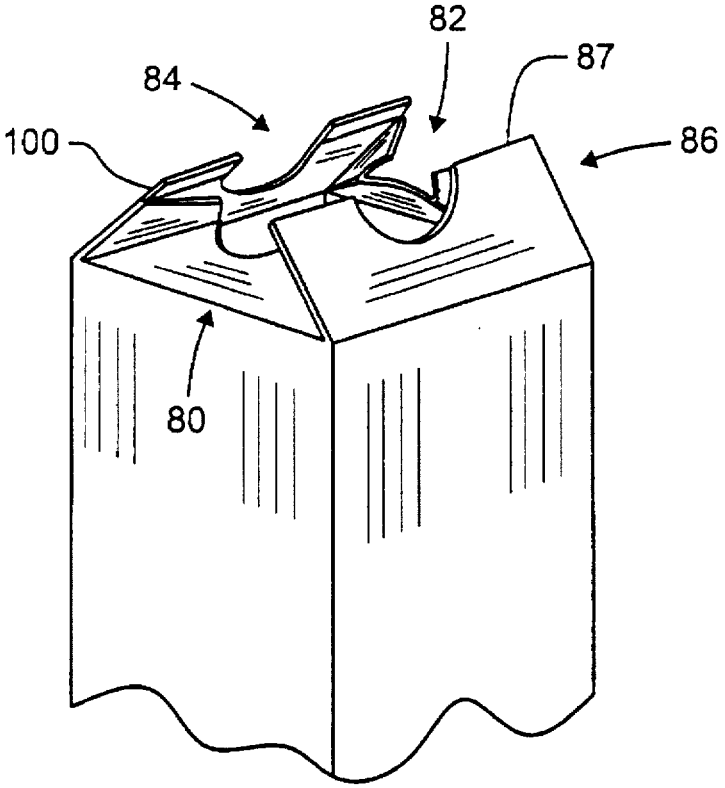

FIG. 1 generally illustrates a perspective view of a container formed according to the present invention (generally denoted by reference numeral 2). The container 2, when completed, may include any desire cross-sectional shape, such as a rectangular shape, circular shape, square shape and the like. Preferably, the container 2 is formed in a rectangular shape with side walls 4, a top 6 and a bottom 8. The top 6 may include a screw cap assembly 10 or the like that includes an opening fitment and corresponding cap.

Turning to FIG. 2, a flat blank 12 is illustrated which is utilized to form the container 2 of FIG. 1. The blank 12 is preferably formed from a laminate material that includes a paperboard substrate disposed between two or more liquid resistant layers, such as layers of polyethylene. The blank 12 includes four panel sections 14 divided from one another along fold lines 16. Optionally, a side overlapping section 18 may be provided integrally along one side of one panel 14 to be used to form the side seam 15 shown in FIG. 3. The side overlapping section 18 is separated from the panel 14 by fold line 20.

As shown in FIG. 3, when the container is folded into its rectangular shape, the side overlapping section 18 is folded inward along line 20 to lie adjacent to the inner surface 22 of the panel 14. The overlapping section 18 includes an edge 24 extending along its length. A side lip 26 is folded along the length of the overlapping section 18 in order to sandwich the lip 26 between the section 18 and the side panel 14 with the side edge 24 isolated from the interior of the container. By folding the lip 26 in this manner, the side edge 24 is not exposed to the liquid product within the container.

Returning to FIG. 2, the panels 14 include side wall portions 28 which define the sidewalls 4 of the formed container 2. The panels 14 also include upper and lower end sections 32 and 30. The end sections 30 and 32 are separated from the side wall portions 28 via fold lines 34 and 36. The upper and lower end sections 30 and 32 also include outer edges 38 and 40. The paperboard substrate of the laminate material is exposed along edges 38, 40 and 24.

The end sections 30 cooperate, when folded upon one another, to define the bottom 8 of the container 2, while the end sections 32 cooperate, when folded, to form the top 6. The lower end sections 30 include an inner pair of end sections 42 and 44 and an outer pair of end sections 58 and 60. The upper end sections 32 include an inner pair of end sections 80 and 82 and an outer pair of end sections 84 and 86. As illustrated, the inner pair of end sections 42 and 44 of the lower end sections 30 and the inner pair of end sections 80 and 82 of the upper end sections 32 are divided from their respective side panels by curved fold lines 36.

In order to facilitate proper folding of the bottom 8 of the container 2, the lower end sections 42 and 44 are further segmented along fold lines 46 and 48 to define middle regions 50 and 52 and laterally disposed side or ear regions 54 and 56. Additionally, the outer end section 58 includes an outermost flap 62 which, as will be shown in connection with FIG. 4, overlaps the seal formed by the sections 30 across the bottom 8 of the container. The end sections 42, 44 and 60 include outer lips 43, 45 and 61, respectively, which are covered by the flap 62.

During formation of the lower end section 30, the inner pair of opposed end sections 42 and 44 are folded inward until lips 43 and 45 intersect proximate the center of the bottom 8. Thereafter, the outer pair of end sections 58 and 60 are folded inward until the lips 61 and 62 join. As the lower end sections 30 fold inward upon one another in the foregoing manner, the ear regions 54 and 56 fold along lines 46 and 48 until overlapping the corresponding middle regions 50 and 52. Thus, the ear regions 54 and 56 are sandwiched between corresponding middle regions 50 and 52 and corresponding outer end sections 58 and 60.

FIG. 4 illustrates the final folding of the lower end sections 30 in the proper relationships. As illustrated, the outer end sections 58 and 60 are folded (as explained below) to join at a seam 59. The lip 61 is folded outward along line 63 away from the interior of the container to isolate the edge 38 from the content of the container. If the curved fold lines illustrated in the lower end 30 of FIG. 4 are employed, the seam 59 resides in a recess thereby providing a generally flattened and stable seating surface for the container. Further details concerning the use of such curved fold lines are described in U.S. Pat. No. 5,474,232, issued Dec. 12, 1995, and entitled "Gable Top Carton and Carton Blank Having Curved Side Creases", which is hereby incorporated by reference.

Returning to FIG. 2, the upper end sections 32 include an inner pair of end sections 80 and 82 and an outer pair of end sections 84 and 86. The end sections 80 and 82 each include middle regions 88 and 90 formed integrally with corresponding laterally disposed ear regions 92 and 94. The ear regions 92 and 94 are separated from corresponding body regions 88 and 90 via fold lines 96 and 98. Optionally, one or more of the end sections 30 may include an overlap strip, such as strip 100 upon end section 84. The end sections 80–86 further include arcuate cutouts 102, 104, 106 and 108, respectively. The cutouts 102–106 combine, as explained below, to form an aperture through the top of the container which ultimately receives the opening fitment.

Folding of the top 6 of the container 2 is illustrated in FIG. 5. As shown, the top is formed by folding end sections 80 and 82 inward until outer tips 81 and 83 (FIG. 4) substantially adjoin one another. Thereafter, end sections 84 and 86 are folded inward until the overlap 100 overlaps the edge 40 of section 86. During this folding operation, the ear regions 92 and 94 are folded inward upon corresponding body regions 88 and 90, respectively, about corresponding fold lines 96 and 98. When folded in this manner, the ear regions 92 and 94 are sandwiched between corresponding middle regions 88 and 90 and adjacent end sections 84 and 86. By folding the upper end sections 32 in this manner substantially isolates many edges of the paperboard substrate that would otherwise be exposed to the product content of the container. All edges, including the edge 40, are isolated from the interior of the container. Only the edges 103, 105, 107 and 109 of the arcuate cutouts 102–108 remain exposed.

As shown in FIG. 6, the cap assembly 10 is inserted through the aperture 112 defined by the cutouts outward from the interior of the container through the opening 112 formed when the arcuate cutouts 102–108 join one another. The cap assembly 10 includes a fitment 114 with a circular base flange 116 and tubular stem 117 projecting outward through the opening 112. The flange 116 includes an upper sealing face 119 which is securely sealed against the interior surfaces 121 of the upper end sections 80, 82, 84 and 86 proximate the opening 112. The fitment 114 seals and isolates the edges 103, 105, 107 and 109 of the cutouts 102, 104, 106 and 108 from the interior of the container. Optionally, the stem 117 may include threads 122 which receive a corresponding threaded cap 124.

Figure 7:
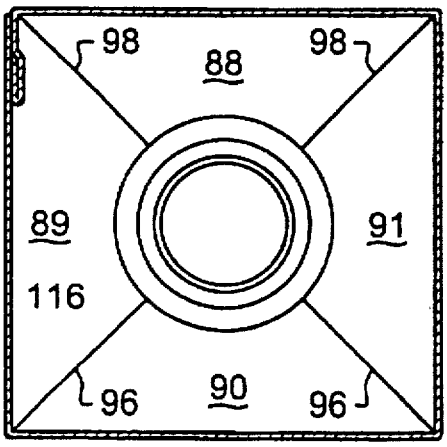

As shown in FIG. 7, the base flange 116 covers a center region of the end sections 80, 82, 84 and 86 to cover any portions of the edges 40 and 103, 105 107 and 109 which would be otherwise exposed. Hence, as viewed from the interior of the container, the product therein is only exposed to body regions 88 and 90 and middle regions 89 and 91 of the end sections 84 and 86, respectively. The fold lines 96 and 98 define intersections between regions 88–91 and form seals therebetween to prevent the product from migrating between the end sections 30.

The foregoing container can be manufactured with a minimal degree of modification to traditional gable-top packaging machines. Such machines include the TR/6™, TR/7™, TR/8™, and Tetra Mini™ packaging machines available from Tetra Pak, Inc.

Figure 8:
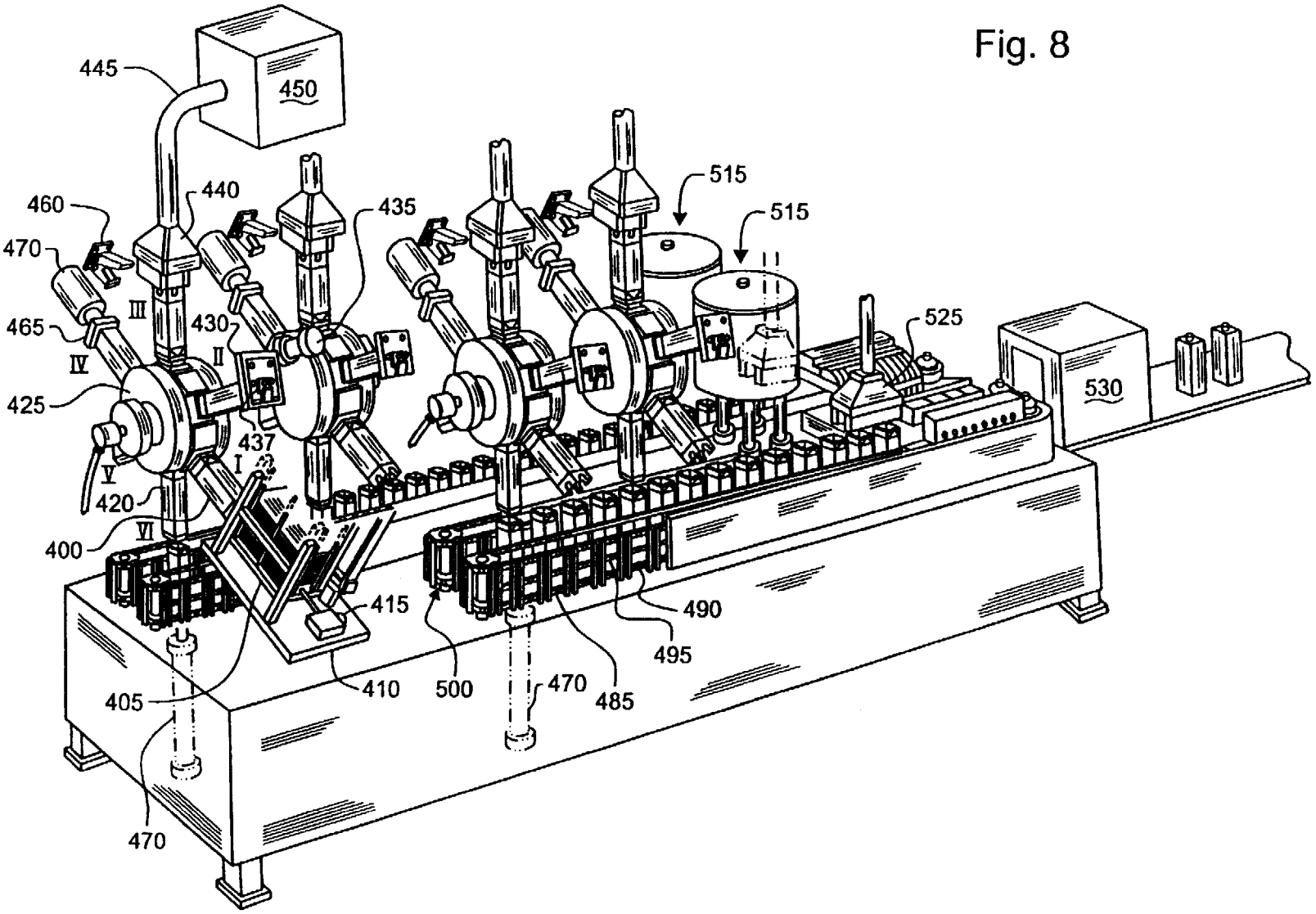
Figure 9:
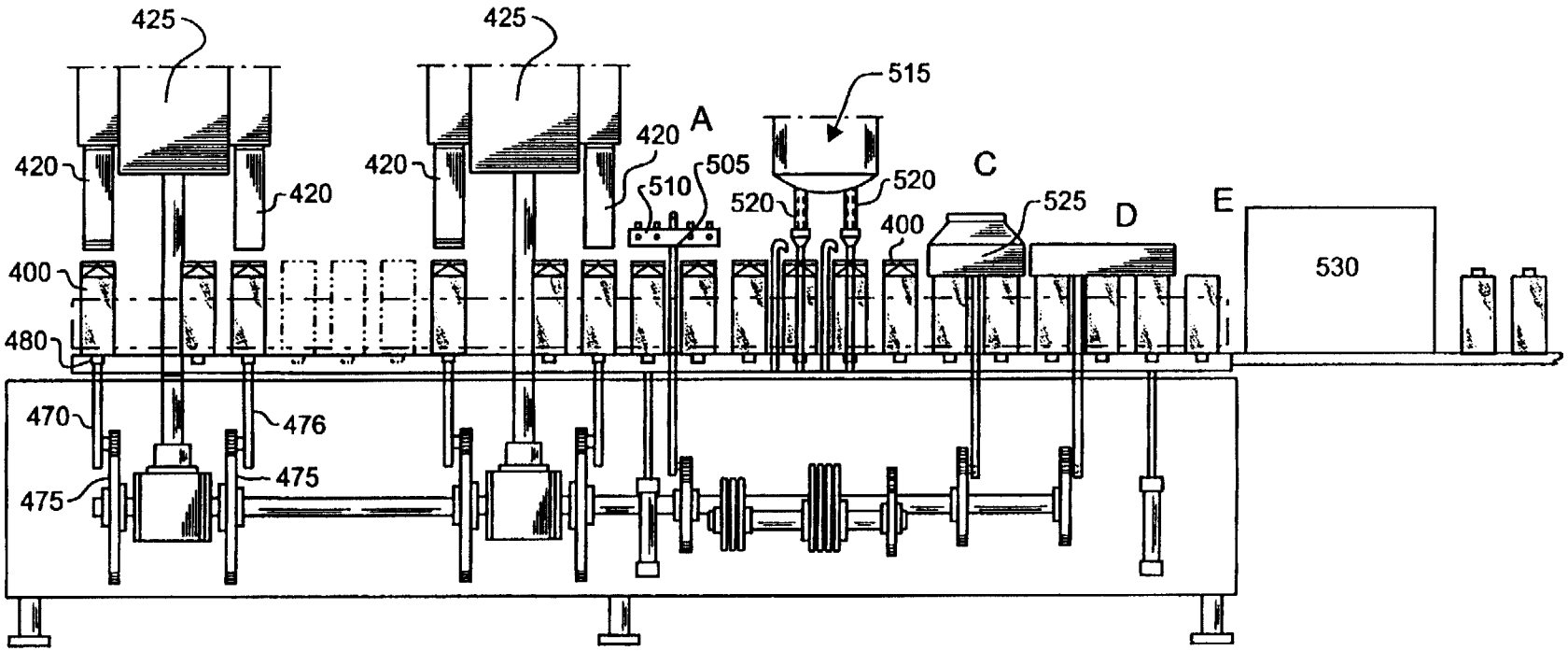

One example of a traditional packaging machine that can be modified to manufacture the foregoing container is shown and described in U.S. Pat. No. 3,820,303. An exemplary embodiment of such a modified machine is shown in FIGS. 8–15. As shown in FIGS. 8 and 9, flat package blanks 400, which have not yet been erected, are discharged from the magazine 405 while at the same time the package blanks 400 are erected in a tubular form, which in the present case has a square cross-section. By means of the feeder device 410, which, in the present embodiment, comprises of a rotatable chain provided with carriers 415, the erected package blanks 400 are pushed onto a mandrel 420 provided on the mandrel wheel 425, the mandrel having been moved in position opposite the feeder device. (in the drawing this position is designated I). Once the blank 400 has been pushed onto mandrel 420, the mandrel wheel 425 is indexed in a counter-clockwise direction until it reaches position II, whereupon the mandrel wheel stops again.

In position II, the upper end 32 of the package blank 400 mounted on mandrel 420 is centrally opposite a folding device 430 controlled by an actuator 435, preferably a pneumatic cylinder. With the aid of the actuator 430, the folding device 43 is moved towards the upper end sections 32 of the package blank 400, the upper end section projecting from mandrel 420, whereby flaps 437 of the folding device 430 are folded inward towards the upper end section of the package blank 400 with a view to initially folding or "breaking" the crease lines previously provided in the upper end section of package blank 400. The folding process is, however, interrupted before the wall section of the package blank, which forms the top, has been completely folded inward to its final position, and owing to the elasticity of the material, sections 32 of package blank 400 which projects from mandrel 420 returns substantially to the position in which it was prior to the folding operation.

When the pre-folding operation is completed, the mandrel wheel 425 is again indexed and stops in position III, in which position the pre-folded upper end sections 32 of package blank 400 are centrally opposite a heating device 440. Through the heating device 440 hot gas, preferably air, is blown against the raised end sections 32 of package blank 400, whereby the panels of the upper end section, which are intended to act as sealing sections are heated to such an extent that the thermoplastic material disposed about the paperboard substrate softens. Additionally, a fitment or a complete cap assembly 10 including the fitment is conveyed through a tube 445 from a supply 450. The tube 445 is moved proximate the mandrel 420 and guides the fitment between the open panels at upper end 32. The fitment engages the mandrel 420 and is held fast thereto by, for example, a vacuum device or the like. The tube 445 is then moved from proximate the mandrel 420 to allow the mandrel with the corresponding fitment secured thereto to again be indexed and move to position IV.

While the mandrel wheel 425 with mandrel 420 moves from position III to position IV, section 32 of package blank 400 projecting from mandrel 420 comes into contact with a folder 460 which folds the upper end sections 32 in the manner described in connection with FIG. 5. At this time, the panels of the upper end sections 32 begin to be heat sealed to one another and to the flange 116 of the fitment 114. When the mandrel 420 has reached position IV, a cooled pressure die 465, which can be displaced by an actuator 470, preferably a pneumatic cylinder, is pressed against the folded and sealed top section, whereby a generally flat container top having a fitment is formed. By cooling the heated parts of the end sections 32 at the same time as the sections are pressed together by the pressure plate 465 and the end of mandrel 420, the heated thermoplastic layer is caused to stiffen once the heated faces have been combined by surface fusion, whereby the sections forming the top are held together in the compressed position so as to form a liquid-proof top. In order to ensure a good seal it is important for the folded top sections to be pressed against one another with great force, and it is advisable to make use of pressures up to several tons, since pressures of this magnitude cause effective flow of the plastic in the sealing zone and closure of any leakage channels which may occur when overlapping layers of material are joined.

Once the base has been pressed on the mandrel wheel is indexed to position V, for which position no operation is provided, so that the container 400 which has been given a formed and sealed top is turned, after a period of time corresponding to one indexing period, to position VI, in which the mandrel 420 is directed downward.

In position VI, the container 400 is pulled from mandrel 420 by means of a pull-off device 470 which is vertically displaceable and has at its front part a suction or gripping device that grips the container 400. The pulling-off operation is effected by raising the pull-off device 470 with the aid of an actuator 475 until its suction or gripping head 480 comes into contact with the top of container 400. When the pull-off device 470 is thereafter caused to move downward, the container 400 is pulled from mandrel 420 and lowered between the retaining devices which are arranged on an intermittently movable chain conveyor 485, by means of which the containers 400 are pulled from the mandrel wheel 425 and are caused to be transported in a substantially horizontal direction in an inverted state. The mandrel wheel 425 is indexed after completion of the pull-off operation to position I, in which a fresh package blank 400 is pushed on mandrel 420 by the feeder device 410.

In the above description, a method of operation has been reported in which a mandrel wheel 425 carries out a complete indexing cycle, but during each indexing pause operations such operations are concurrently carried out in all positions with the exception of position V. This means that a completely processed container 400 is pulled off during each indexing pause while at the same time a fresh package blank 400 is mounted on mandrel 420. Accordingly, in the present embodiment, the time between two consecutive indexing operations is selected so that all operations in the various positions can be completed.

In the illustrated embodiment, since two or more mandrel wheels 425 are simultaneously associated with a conveyor 485, two or several containers 400 provided with a sealed and formed top are at all times transmitted from the mandrel wheel 425 to the conveyor 485 by means of two or more pull-off devices 470. With the machine here described each conveyor 485 is associated with two mandrel wheels 425, so that two containers 400 are transmitted to the conveyor 485 during each indexing operation. Since the conveyor is supplied with two containers 400 during each indexing operation, the container must be moved by two package divisions during each indexing operation, and all processing stations for folding the tops of the containers and for filling and closing the containers 400 must be duplicated. However, since the processing stations are situated in lateral juxtaposition, a common drive mechanism can be used for each pair of devices. Alternatively, one or more servomotors may be used to drive the corresponding mechanisms in a timed relationship.

Each conveyor 485 comprises two parallel endless chains which are provided with retaining devices 490 whereby the retaining devices located centrally opposite one another on the two chains form between them a space 495 which is so designed that an inverted container 400 can be placed within it. When a container 400 is pulled from mandrel 420 by the pull-off device 470 and moved downward, it is introduced into the space 500 defined by the retaining devices 490. For this to be possible, the movement of the conveyor is synchronized with that of the mandrel wheel so that the conveyor moves forward by two retaining device divisions during each indexing operation of the mandrel wheel 425 while fresh empty spaces bounded by the retaining elements 490 are always directly below the mandrels 420 in position VI.

At station A the bottom end sections 30 of the containers 400 are pre-folded by means of a folding device 505 attached to a yoke 510 which can be raised and lowered. The folding operation is effected by at least partially folding the bottom end sections 30 in the manner described above. The folding has only the purpose of bending or "breaking" the crease line pattern which has been provided on the package blank and which is intended to define the folding pattern necessary for sealing the top of the container, and hence the folding operation is not completed but the folding device 505 is raised to its upper position once the crease line pattern has been bent.

After indexing of the mandrel wheel 425 and displacement of the conveyor 485 by one stage, the folded containers 400 are at station B, i.e., directly below the filling device 515, by means of which a measured quantity of the product is introduced into the containers. Filling of the containers 400 is effected in such a way that the containers are raised about the filling tubes 520 by means of a lifting mechanism and gradually lowered as the container is filled. Thereafter the filled containers are moved in stages and synchronously with the indexing mechanism to station C, where the bottom end sections 30 of the container are directly below a heating device 525. Just like the top heating device 440, the bottom heating device 525 consists of a heating device provided with holes, whereby hot air is blown through the holes which are arranged in such a pattern that the heat reaches only those parts of upper end sections 30 which are intended to be sealed against one another. The thermoplastic material is quickly heated to the point of plastification whereupon the containers 33 are moved from station C to station D where the bottom end sections are finally folded and sealed to the configuration shown in FIG. 4. At station E at the end of the conveyor, the retaining devices which surrounded the containers during transportation are separated and the completed packages are removed from the packaging machine and inverted by a package inverting mechanism 530 that inverts the containers 400 to a righted position for subsequent transport and distribution.

Although the drive and coordination of the various mechanisms at the processing stations can be accomplished through the use of one or more servomotors and an appropriate control system, the packaging machine of the instant embodiment is driven with the aid of an electric motor and a corresponding set of drive shafts and cam mechanisms. However, it will be readily recognized that various configurations are suitable for driving and coordinating the machine stations the illustrated embodiment being but one such configuration.

With packaging machines of the type previously described, the top of the package is formed by folding the upper end sections 32 towards each other and about the fitment. The sections 32 which form the top and are folded inward are retained in the folded-inward position by heating the thermoplastic lining of the package blank 400 in the region of sections 35 which form the base, until plastification occurs, whereupon the thermoplastic material lining the surfaces of the sections is bonded after folding by surface fusion so as to form a permanent seal.

Figure 11:
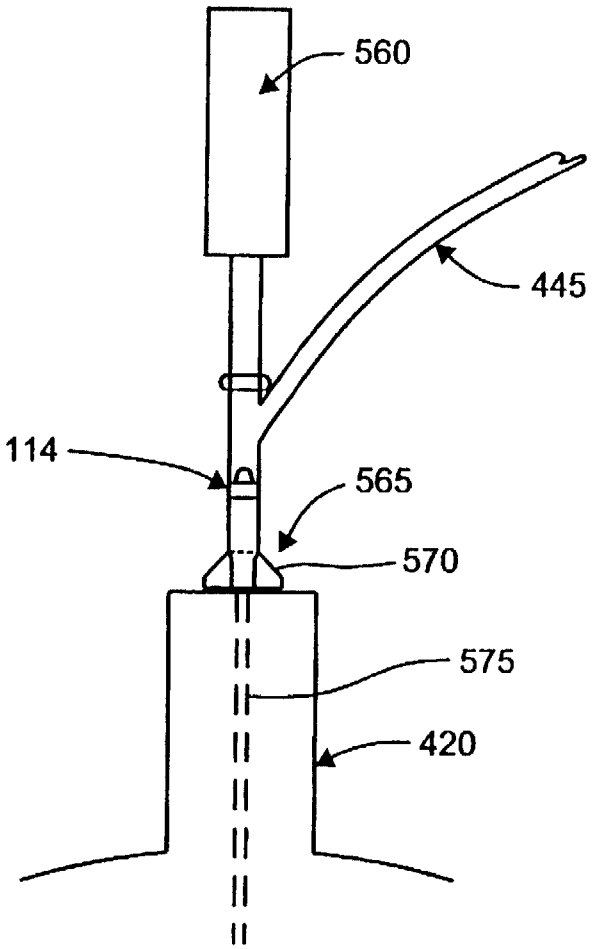
Figure 10:
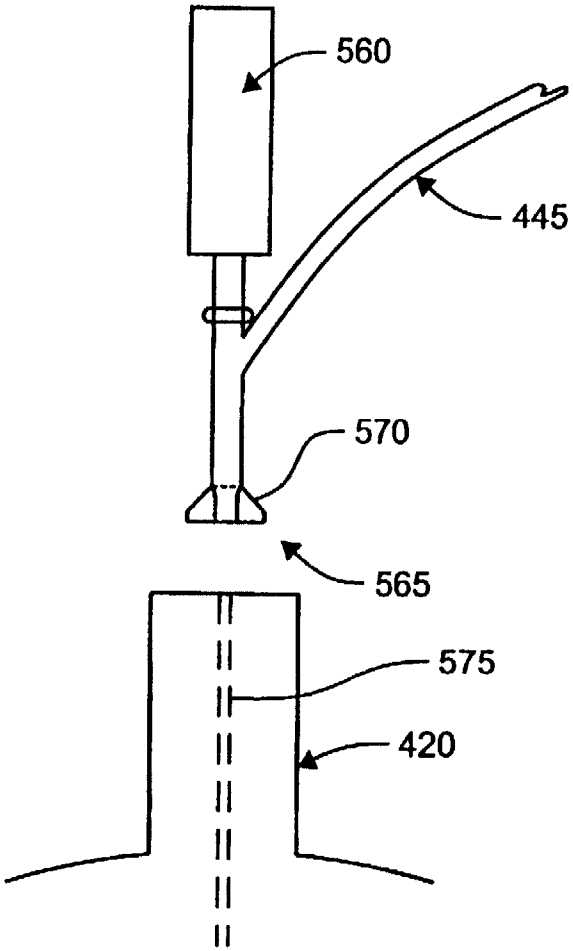
Figure 12:
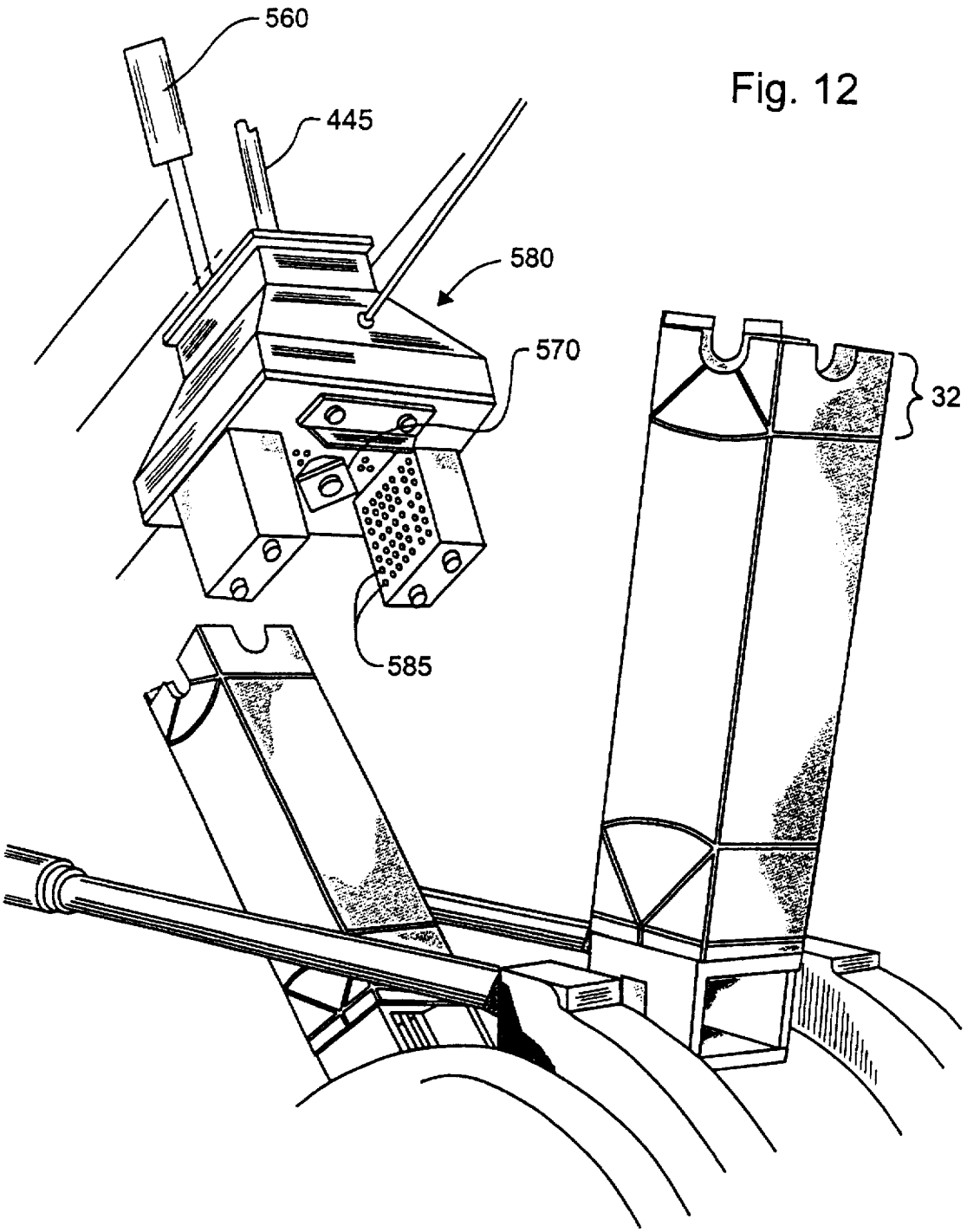

FIGS. 10–12 illustrate one manner in which the top end panels 32 of the containers 400 may be heat sealed about the fitment. In the embodiment illustrated, the fitment 114 is introduced at position III and, further, heating of the top end sections 32 likewise takes place here. The fitment 114 may be introduced in the manner shown in FIGS. 10 and 11 whereby a linear actuator 560 is connected to drive the tube 445 between a first position in which the end 565 of tube 445 including a deflector 570 are clear of the mandrel 420 and the top end panels 32 extending from the mandrel 420, and a second position in which the end 565 of tube 445 is disposed proximate a central portion of the mandrel 420 corresponding to the position at which the fitment 114 will be secured to the container 400. When disposed in the second position, illustrated in FIG. 11, the fitment 114 is conveyed through tube 445 by air, gravity, or the like, to cover the opening of a central vacuum channel 575 that is connected to a vacuum source (not shown). The vacuum channel 575 assists in securing the fitment 114 to the mandrel 420 while the top of the container 400 is folded and heat sealed about the fitment 114.

Heating of the upper end panels 32 is best illustrated in connection with FIG. 12. As shown, the containers 400 are presented to a heating system 580 that provides a hot, sterile gas, such as air, through a plurality of apertures 585 disposed at positions selected to direct the hot gas to the portions of the upper end flaps 32 that will be heat sealed to one another. The hot gas is provided at a temperature sufficient to plasticize the polymer layers that are to be used to heat seal the container 400 over the dwell time of the indexing period. It is during this dwell time that the fitment 114 is conveyed into position for sealing to the container 400. The fitment 114, preferably formed from a polymer material, is advantageously protected from the hot gas by the tube 445 and deflector 570. As the containers 400 are indexed from position III to position IV, the upper end panels 32 are folded by the folding mechanism 460 before reaching the cooled pressure die 465. One embodiment of such a folding mechanism is illustrated in FIGS. 13–15. Further details concerning the operation of the folding mechanism can be found in the foregoing '303 patent, which is incorporated by reference.

As a further alternative, the method by which the container is formed may be modified such that the upper sections 32 are folded upon one another and sealed to one another in a first station prior to addition of the fitment. Thereafter, the container may be removed from the mandrel 420 and the fitment introduced through the opposed open bottom end of the sleeve until the fitment 114 engages the interior surface of the container upper end. Thus, the upper end of the container would be formed at a first station and the fitment 114 would be subsequently introduced at a second station, with the flange 220 being separately sealed to the interior surfaces of the end sections 32. Alternatively, other methods of securing the fitment, such as gluing it to the container, ultrasonic attachment, or the like, may be employed.

While particular elements, embodiments and applications of the present invention have been shown and described, it will be understood, of course, that the invention is not limited thereto since modifications may be made by those skilled in the art, particularly in light of the foregoing teachings. It is, therefore, contemplated by the appended claims to cover such modifications as incorporate those features which come within the spirit and scope of the invention.

I claim:

1. A paperboard-based container comprising:

a laminate sleeve having a paperboard substrate, the sleeve having side panels folded to form a generally rectangular cross-section, the sleeve further having an upper end section and a lower end section divided at fold lines from the side panels, the upper end section divided by fold lines into an inner opposed pair of sections and an outer opposed pair of sections, each of the inner and outer pair of opposed sections having cutouts, each of the inner pair of opposed sections being defined by fold lines to form a middle region and laterally opposed side regions on either side of the middle region, the upper end section being folded and sealed to form a generally flattened top of the container wherein each of the laterally opposed side regions of each inner pair of opposed sections lies between a portion of a respective one of the outer pair of opposed side portions and a respective middle region, the cutouts of the upper end section defining an aperture having edges with exposed paperboard substrate; and a fitment having a flange and a neck, the neck extending from an interior portion of the container to an exterior portion of the container, the flange being secured over an interior surface of the container and facilitating protection of the edges of the exposed paperboard from the interior of the container.

2. A paperboard-based container according to claim 1, wherein the fitment is a spout.

3. A paperboard-based container according to claim 2 and further comprising a cap over the neck of the fitment.

4. A paperboard-based container according to claim 2 wherein the neck is threaded, and further comprising a threaded cap secured to the neck.

5. A paperboard-based container according to claim 1, wherein the cutouts are arcuate cutouts that combine to define a generally circular aperture at a centrally disposed location of the top of the container.

6. A paperboard-based container according to claim 1 wherein the lower end section are folded to form a bottom in which all edges of exposed paperboard substrate are isolated from the interior of the container.

7. A paperboard-based container according to claim 6 wherein the lower end section and the upper end section are sealed to form a hermetically-sealed container.

8. A paperboard-based container according to claim 1 wherein the lower end section and the upper end section are sealed to form a hermetically-sealed container.

9. A paperboard-based container comprising:

a laminate sleeve having a paperboard substrate, the sleeve having side panels folded to form a generally rectangular cross-section, the sleeve further having an upper end section and a lower end section divided at fold lines from the side panels, the upper end section divided by fold lines into an inner opposed pair of sections and an outer opposed pair of sections, each of the inner and outer pair of opposed sections having cutouts, each of the inner pair of opposed sections being defined by fold lines to form a middle region and laterally opposed side regions on either side of the middle region, the upper end section being folded and sealed to form a generally flattened top of the container wherein each of the laterally opposed side regions of each inner pair of opposed sections lies between a portion of a respective one of the outer pair of opposed side portions and a respective middle region, the cutouts of the upper end section defining an aperture having edges with exposed paperboard substrate; and a fitment having a flange, the flange being secured over an interior surface of the container and facilitating protection of the edges of the exposed paperboard from the interior of the container.

10. A container as claimed in claim 9 wherein the fitment is in the form of a disk.

* * * * *